US009109751B2

(12) United States Patent
Schimp

(10) Patent No.: US 9,109,751 B2
(45) Date of Patent: Aug. 18, 2015

(54) COMPRESSED GAS STORAGE AND COLLECTION APPARATUS

(71) Applicant: Compressed Energy Systems, LLC, Eldorado, IL (US)

(72) Inventor: Christopher E. Schimp, Eldorado, IL (US)

(73) Assignee: Compress Energy Systems, LLC, Eldorado, IL (US)

( * ) Notice: Subject to any disclaimer, the term of this patent is extended or adjusted under 35 U.S.C. 154(b) by 22 days.

(21) Appl. No.: 13/840,161

(22) Filed: Mar. 15, 2013

(65) Prior Publication Data

US 2014/0263362 A1 Sep. 18, 2014

(51) Int. Cl.

| | |
|---|---|
| ***F17C 1/00*** | (2006.01) |
| ***F17C 5/06*** | (2006.01) |
| ***F17C 6/00*** | (2006.01) |
| ***F17C 7/00*** | (2006.01) |
| ***F17C 9/00*** | (2006.01) |

(52) U.S. Cl.

CPC ... *F17C 5/06* (2013.01); *F17C 6/00* (2013.01); *F17C 7/00* (2013.01); *F17C 9/00* (2013.01); *F17C 2201/0104* (2013.01); *F17C 2201/032* (2013.01); *F17C 2201/054* (2013.01); *F17C 2221/033* (2013.01); *F17C 2223/0123* (2013.01); *F17C 2223/033* (2013.01); *F17C 2223/035* (2013.01); *F17C 2225/0123* (2013.01); *F17C 2225/033* (2013.01); *F17C 2225/035* (2013.01); *F17C 2227/0157* (2013.01); *F17C 2265/061* (2013.01); *F17C 2265/065* (2013.01); *F17C 2270/0147* (2013.01); *F17C 2270/0149* (2013.01)

(58) Field of Classification Search

CPC ..... F17C 5/06; F17C 6/00; F17C 7/00; F17C 9/00

USPC ..... 137/236.1; 405/53; 220/567.1

See application file for complete search history.

(56) References Cited

U.S. PATENT DOCUMENTS

| | | | | |
|---|---|---|---|---|
| 5,207,530 | A * | 5/1993 | Brooks et al. | 405/55 |
| 6,840,709 | B2 * | 1/2005 | Dahlem et al. | 405/53 |
| 7,729,976 | B2 * | 6/2010 | Hill et al. | 705/37 |
| 7,784,485 | B2 * | 8/2010 | Schelling et al. | 137/266 |
| 8,523,481 | B2 * | 9/2013 | Schimp | 405/53 |

* cited by examiner

*Primary Examiner* — Kevin Lee

(74) *Attorney, Agent, or Firm* — Bryan Cave LLP

(57) ABSTRACT

An apparatus for storing and collecting compressed gas is disclosed. The apparatus includes a gas vessel for the storage of gas and further includes a sheath surrounding the gas vessel for collecting any gas that escapes from the vessel.

15 Claims, 6 Drawing Sheets

COMPRESSED GAS STORAGE AND COLLECTION APPARATUS

FIELD OF THE INVENTION

The field of the invention relates to methods and systems for recovering, storing, transporting, and using methane gas and conventional Natural Gas.

BACKGROUND OF THE INVENTION

There are several limitations and problems associated with prior art gas storage and loading systems, particularly when used to load a tanker or vehicle with gas. For example, when using certain prior art storage and loading systems, it would typically take up to 24 hours to compress 300 mcf of methane gas into a tanker at a pressure of 3,000 psi. Similar limitations apply to the smaller tanks used in standard natural gas-operated automobiles. The rate-of-transfer of gas into such tanks has been limited for several reasons. Specifically, if the gas is loaded too fast into the tank using the prior art methods, the gas undergoes an undesirable and extreme drop in temperature, which may cause the gas to liquefy and/or the gas loading regulator to freeze.

Accordingly, a demand exists for methods and systems that provide the quick and safe transfer of gas into storage facilities, tankers, vehicles, including intermediate containment systems, for storage and/or delivery. Still further, a demand exists for improved capacitor arrangements for gas storage and devices for transferring gas from one containment system to another. As explained further below, the present invention addresses such demand.

SUMMARY OF THE INVENTION

Among the various aspects of the present invention is the provision of devices and methods for storing gas and for transferring and/or transporting gas from one containment system to another.

In certain embodiments, readily available commercial CNG transport trailers or tankers are utilized to carry out the methods described herein. In accordance with the invention, however, such tankers are not required to be left at the unloading and loading sites for long periods of time, as is the case with certain prior art methods and systems. Instead, the loading and unloading steps described herein are accomplished quickly and efficiently. As a result, as few as one tanker can be used, instead of multiple tankers, to carry out certain methods described herein, thereby providing a substantial cost advantage.

In most areas where coal mining is present, there is an abundance of unused or abandoned oil wells, and in some cases, oil wells that cover the countryside. For instance, in the southern region of the state of Illinois and in Kentucky, both of the United States, many of these wells are about 3,000 feet deep with an 8 inch casing that has been cemented into the ground. The formations in which these wells produce, or formerly produced, can be easily sealed off to keep fluids out and the gas in. Also, advantageously, these wells are capable of holding high pressures, for instance, 4,000 psi.

As a result, according to the invention, it has been found that just two wells, for instance, 8 inches in diameter by 3,000 feet deep can be used as subterranean capacitors for holding twice as much compressed gas as the biggest and highest volume bulk transport tanker, at a high pressure, such as 3,000 psi. With 600,000 cubic feet of gas (600 mcf) charged on site in two oil wells used as capacitors at this pressure, or 300,000 cubic feet of gas (300 mcf) charged on site in one oil well used as a capacitor at this pressure, a tanker having a capacity of 300 mcf can be loaded with gas therefrom to this pressure very quickly, for instance, in less than half an hour.

Unused or abandoned oil wells are a liability for plugging if not operated. Many companies are willing to give them away due to plugging costs up to $5,000 per well. Thus, as an example, using oil wells as subterranean capacitors can allow a compressor to operate 24 hours for filling the capacitors, enabling a smaller compressor to be used, steady flow from the production wells, and quick loading into the transport tanker to deliver the gas to the end user. Additionally, only one transport is needed instead of the three tankers that are typically required when using prior art systems.

Similarly, at the unloading facility, one or more subterranean capacitors can be used, which can be, for instance, one or more producing or non-producing oil wells, an unused mine, a subterranean formation, or a subterranean cylinder. As used herein, a "subterranean cylinder" refers to a subterranean structure that is similar in size, dimension, and construction to an oil well. For example, a "subterranean cylinder" may consist of a hole drilled into the ground that is surrounded by, for example, several inches of cement casing. The hole is preferably lined with a material, such as steel or any other suitable liner. The subterranean cylinder may be constructed near the site of a producing well for the purpose of extracting gas from the producing well and storing the gas in the subterranean cylinder. In other words, the invention contemplates that, in addition to abandoned oil wells, newly constructed subterranean cylinders may be positioned near producing wells for the purpose of storing gas therein. Still further, the invention provides that subterranean cylinders may be constructed and positioned at any location that would be convenient to load gas into vehicles—i.e., Natural Gas filling stations. A "producing well," as used herein, refers to any source of methane gas, Natural Gas, combinations thereof, and/or constituents thereof.

An advantage of using a subterranean capacitor according to the invention is that it will take gas quickly, but let it out slowly, which is what is typically required by end users, because the gas usage rate of the user is typically lower than what can be supplied by unloading at a rate of 300 mcf per hour.

An abandoned or unused coal mine can have a very large capacity as a capacitor and can receive gas very quickly. Multiple subterranean cylinders and/or oil wells can be manifolded together, to also allow unloading quickly. When oil wells are drilled 330 feet to 660 feet from each other, which is common, the oil wells are sufficiently close to each other, such that a high pressure pipe can be used to economically connect them together at the unloading facility.

The method of unloading and loading according to the invention reduces the number of transports used, eliminates expensive storage and utilizes an asset, i.e., an abandoned well or mine, that would otherwise be rendered worthless. This method makes a significant difference in the economics and will now allow stranded gas to be brought to market, thereby lessening dependence on foreign energy.

Compressed Gas In-Ground Capacitors Advantages

Utilizing the subterranean capacitors of the present invention, and/or unused or abandoned oil wells already in place as subterranean capacitors, to compress methane gas (or Natural Gas) up to a high pressure, for instance, 3,000 psi, also provides a geothermal advantage. With the well so deep in the ground, the area or geology of the earth around the well will eventually, after several days, heat up the surrounding rock. This can be advantageous according to the invention, as the surrounding earth can therefore be used as a thermal insulator for the gas in the capacitor, to conserve the heat thereof. In contrast, if the gas was circulated through several miles of underground pipe, the geothermal action would cool the gas down. A compressor running 24 hours per day, every day, at 3,000 psi would create a tremendous amount of heat, up to 200 degrees. To capture the heat is very difficult if loading transports on a daily basis out of surface storage, due to heat lost to the atmosphere. Insulation and/or heaters typically have to be used when the gas is unloaded into the transport. Whereas, in the capacitor of the invention, as a result of the insulating effect, the surrounding rock heats up and retains the heat, even after loading transports on a daily basis. This phenomenon is comparable to certain attributes of masonry fireplaces, wherein the stone is heated from the fire and then after the fire goes out, the stone will continue to radiate heat for some time. Therefore, the geothermal action actually helps keep gas stored in the capacitor at an elevated temperature, even after frequent discharging of the capacitor, for instance, every 24 hours.

Another advantage of the invention is keeping the gas at an elevated temperature during loading of a transport from the capacitor (i.e., discharging the gas capacitor). When 3,000 psi of gas is discharged initially into an empty transport at 0 psi, the pressure drop is tremendous, as is the velocity of the gas flow. This creates a freezing action, such that the temperature of the gas will typically drop 1 degree Fahrenheit for every 15 psi drop in pressure. This will therefore typically drop the temperature 200 degrees Fahrenheit over the course of the unloading, which can cause the regulators to freeze even if they are insulated. Gas will also liquefy at −220 degrees Fahrenheit, which should also desirably be prevented. The gas stored in an insulated capacitor of the present invention will retain much of its heat from compression, over time, so as to still be at an elevated temperature when transferred to a transport vehicle such as a tanker, mobile refueling station, or the fuel tank of an automobile. As a result, when loading from one or more capacitors into an initially low pressure tanker (or containment system of a refueling station or the fuel tank of an automobile), the temperature drop will be from an elevated temperature, much higher than, for instance, the ambient air temperature, such that a freezing action can be substantially avoided.

One problem associated with gas freezing is that, in some embodiments, the gas is well-head gas that has not yet been processed. In accordance with these embodiments, the gas capacitor is in the field to facilitate transportation from the well head to the processing center. Prior to processing, the gas can contain moisture, which is removed during processing. This moisture can cause problems if the gas temperatures are well below zero degrees Fahrenheit during loading. The geothermal capability of the gas capacitor of the invention will reduce this problem, because the cooling of the gas can be retarded or slowed by the insulating nature of the earth or the formation surrounding the capacitor or capacitors, such that the drop in temperature is not as drastic. Given that the loaded gas will still have at least a somewhat elevated temperature, even after being transported for several hours, for instance, 1 to 2 hours, this will also facilitate unloading of the gas into the next containment system (e.g., another capacitor, another transport tanker, the fuel tank of a vehicle, and the like).

The Transport Unloading Gas Capacitor

As the gas is unloaded from the capacitor from a pressure of, for example, 3,000 psi and loaded into a transport tanker (or the fuel tank of a vehicle), the gas again will get very cold. This temperature can cause freezing problems before the gas arrives at the processing plant or is otherwise combusted in a vehicle engine. Using a number of wells (or subterranean cylinders) as capacitors at the unloading site, for instance, three wells (or a formation, an unused or abandoned coal mine, or one or more subterranean cylinders), the geothermal action of the normalized temperature of the subterranean surroundings of the capacitor, for instance, about 58 degrees Fahrenheit, will advantageously warm up the gas prior to loading.

Also, utilizing a well or subterranean cylinder in connection with a geological formation such as sand rock as a gas capacitor will allow the gas to load into the formation while holding pressure in the capacitor. The pressure holding saves pressure from the compression that was generated at the well sites which will eliminate the need for a compressor at the unloading site. This pressure can then be used to deliver the gas out of the gas capacitor to the gas processing plant, vehicle tank, or other end user. The gas pressure can be controlled with a pressure reducing regulator from the gas capacitor to the processing plant instead of a compressor. It is anticipated that the formation portion of the capacitor will be able to take several tanker loads of gas before a portion of the gas is to be removed from the capacitor. This provides a cushion in the system which will drive the gas and/or save the pressure during discharging as long as the amount of gas discharged during, for instance, a 24 hour period is the same that is loaded into the capacitor during the same 24 hour period.

Briefly, therefore, in accordance with one aspect, the present invention is directed to method for delivering gas to a vehicle. In one embodiment, the method involves, for example, transferring gas from a producing well to a subterranean capacitor and storing the gas in the capacitor; loading the gas from the capacitor into a tanker at a rate that would be effective to load 300 mcf of gas to a pressure of at least about 3,000 psi in thirty minutes or less; and loading the gas from the tanker into a tank of the vehicle at a rate of 1 mcf per minute, to a final pressure of at least about 3,000 psi.

In another embodiment, the method involves, for example, storing gas that is derived from a producing well in a subterranean capacitor; loading the gas from the subterranean capacitor into a tanker at a rate that would be effective to load 300 mcf of gas to a pressure of at least about 3,000 psi in thirty minutes or less; and loading the gas from the tanker into a tank of the vehicle at a rate of 1 mcf per minute, to a final pressure of at least about 3,000 psi. In these embodiments, the tank is preferably a container housed within or connected to the vehicle from which gas is withdrawn for the purpose of providing combustible fuel to an engine of the vehicle.

Another aspect of the present invention is directed to a method for delivering compressed gas to a vehicle using a threaded union. In one embodiment, the method involves, for example, joining, by a threaded union, a first mating end positioned on a tank of the vehicle and a second mating end positioned at the distal end of a hose connected to a tanker containing compressed gas. The threaded union comprises a nut that draws together the first and second mating ends. Once the mating ends are threadably joined, compressed gas from the tanker is delivered to the tank of the vehicle via the hose.

In another embodiment, the method involves, for example, storing gas that is derived from a producing well in a subterranean capacitor; loading the gas from the subterranean capacitor into a tanker at a rate that would be effective to load 300 mcf of gas to a pressure of at least about 3,000 psi in thirty minutes or less; and joining, by a threaded union, a first mating end positioned on a tank of the vehicle and a second mating end positioned at the distal end of a hose connected to the tanker, the threaded union comprising a nut that draws together the first and second mating ends; and delivering compressed gas from the tanker to the tank of the vehicle via the hose.

Yet another aspect of the present invention is directed to a compressed gas storage and collection apparatus comprising one or more storage capacitors including a gas vessel positioned partially or completely underground. The storage capacitor includes a gas vessel having a perimeter wall defining an inner cavity for the storage of gas, the perimeter wall including a middle section connecting a bottom end and a top end, an inner surface, and an outer surface. A sheath surrounds the perimeter wall and extends from a closed top portion proximate the top end of the perimeter wall towards an open end proximate the bottom end of the perimeter wall, the sheath defining an open region between the outer surface of the perimeter wall and the sheath for the collection of escaped gas from the vessel.

Other objects and features will be in part apparent and in part pointed out hereinafter.

BRIEF DESCRIPTION OF THE DRAWINGS

The details of the present disclosure, both as to its construction and operation can best be understood with reference to the accompanying drawings, in which like numerals refer to like parts, and in which.

DETAILED DESCRIPTION OF THE INVENTION

The accompanying Figures and this description depict and describe embodiments of a beverage dispenser in accordance with the present invention, and features and components thereof. It should also be noted that any references herein to front and back, right and left, top and bottom and upper and lower are intended for convenience of description, not to limit the present invention or its components to any one positional or spatial orientation.

Figure 1:
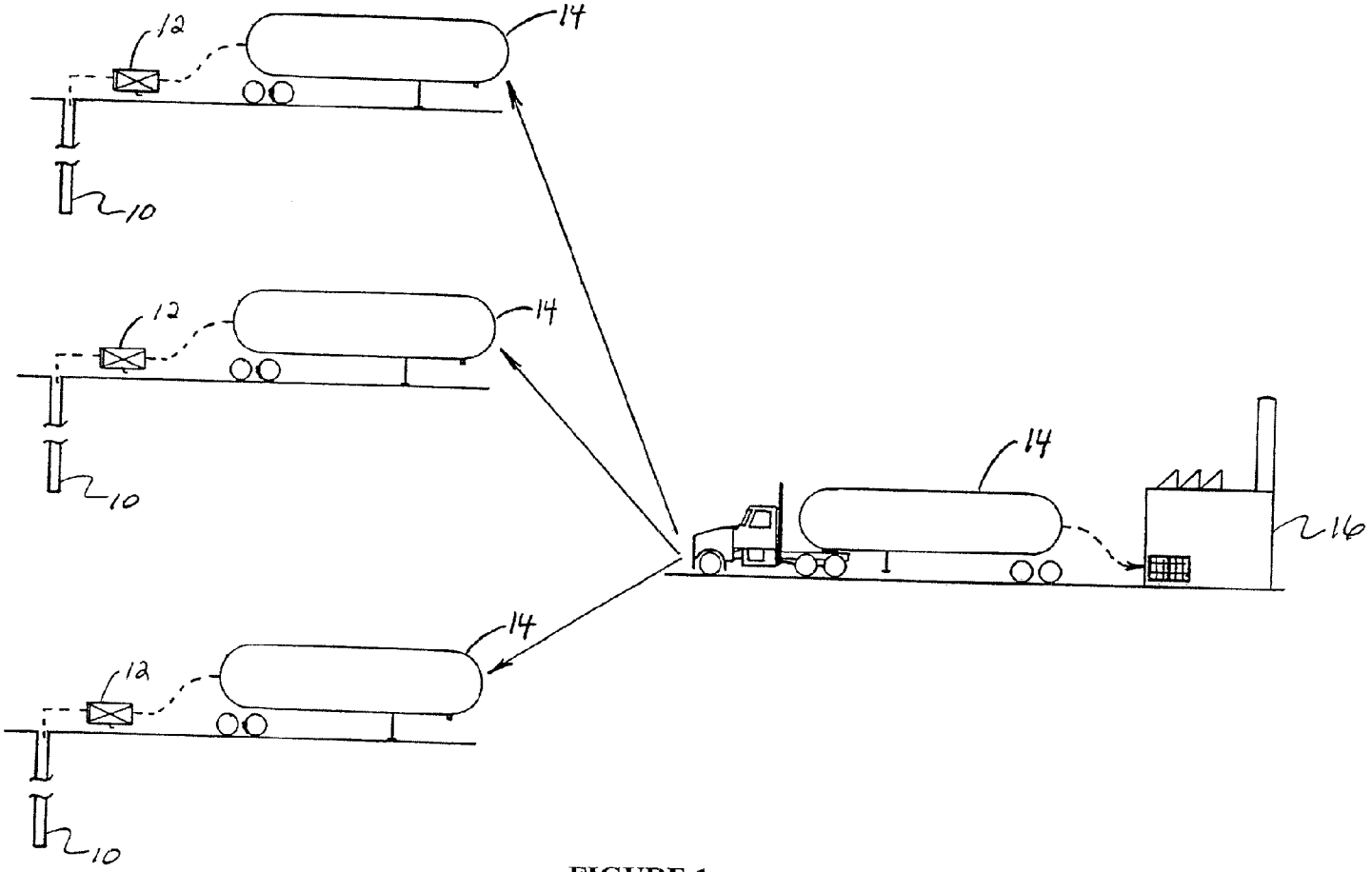
FIG. 1 is a simplified schematic diagram of a prior art method and apparatus for recovering and transporting methane gas.

Referring now to the drawings, wherein like numerals refer to like parts, FIG. 1 illustrates well-known prior art apparatus and methods for recovering and transporting methane gas from a source, such as one or more gas wells in association with one or more underlying coal mines, and transporting the methane gas to an end user, such as, but not limited to, a power generation facility, pipeline, or the like. Essentially, at one or more gas wells 10, conventional, well-known apparatus for recovering methane gas therefrom will typically include a compressor 12 in connection with the well 10 using a suitable pipe network (shown by the dotted lines) for receiving or drawing methane gas from a well 10 and compressing the gas into a suitable transport tanker 14. Such tankers 14 are also of conventional, well-known construction and operation and can typically hold gas compressed up to about 3,000 psi. At the typical rate at which the methane gas can be extracted and compressed, it will typically take up to 24 hours to compress 300 mcf of methane gas into a tanker 14 at that pressure, which is the typical capacity of a tanker. At an end user, such as a co-firing power plant 16, a typical 300 mcf tanker can be unloaded in about 8 hours, as denoted by the dotted arrow. As a result, for three gas wells 10, it is common to utilize four tankers 14, for providing a continuous supply of methane gas to an end-user, such as a co-firing power plant 16. This can be quite expensive capital wise, as tankers, such as the tankers 14, can cost several hundred thousand dollars each.

At the loading end, typically tankers 14 must be loaded relatively slowly, for instance, over a 24 hour period, because the compressing of the gas results in heating of the gas, which can cause dangerous overheating of the tanker 14, if filled too quickly. At the end user site, when the gas is unloaded, if again done too quickly, the unloading apparatus, as well as regions of the tanker 14, can be subjected to freezing, which can also be a dangerous and/or create a damaging condition. As an alternative, it has been contemplated to utilize above ground gas storage tanks in connection with one or more gas wells, such as wells 10 illustrated. However, above ground storage tanks still must be filled slowly, and represent a significant capital expense. As another factor, at the loading end, if the ambient temperature is hot, and/or the tanker 14 is exposed to significant sunlight, the ability of the tanker 14 to dissipate heat can be reduced, thereby requiring slower loading. Similarly, at the unloading end, if ambient temperatures are low, and/or it is dark or cloudy, unloading speed may have to be reduced, to minimize freezing of the tanker and unloading apparatus. Also, at the unloading end, it has been contemplated to utilize above ground storage tanks. However, the gas must typically be compressed into the above ground tank. Thus, the capital expenditures and operating costs can be significant, making this an uneconomical alternative.

Figure 2:
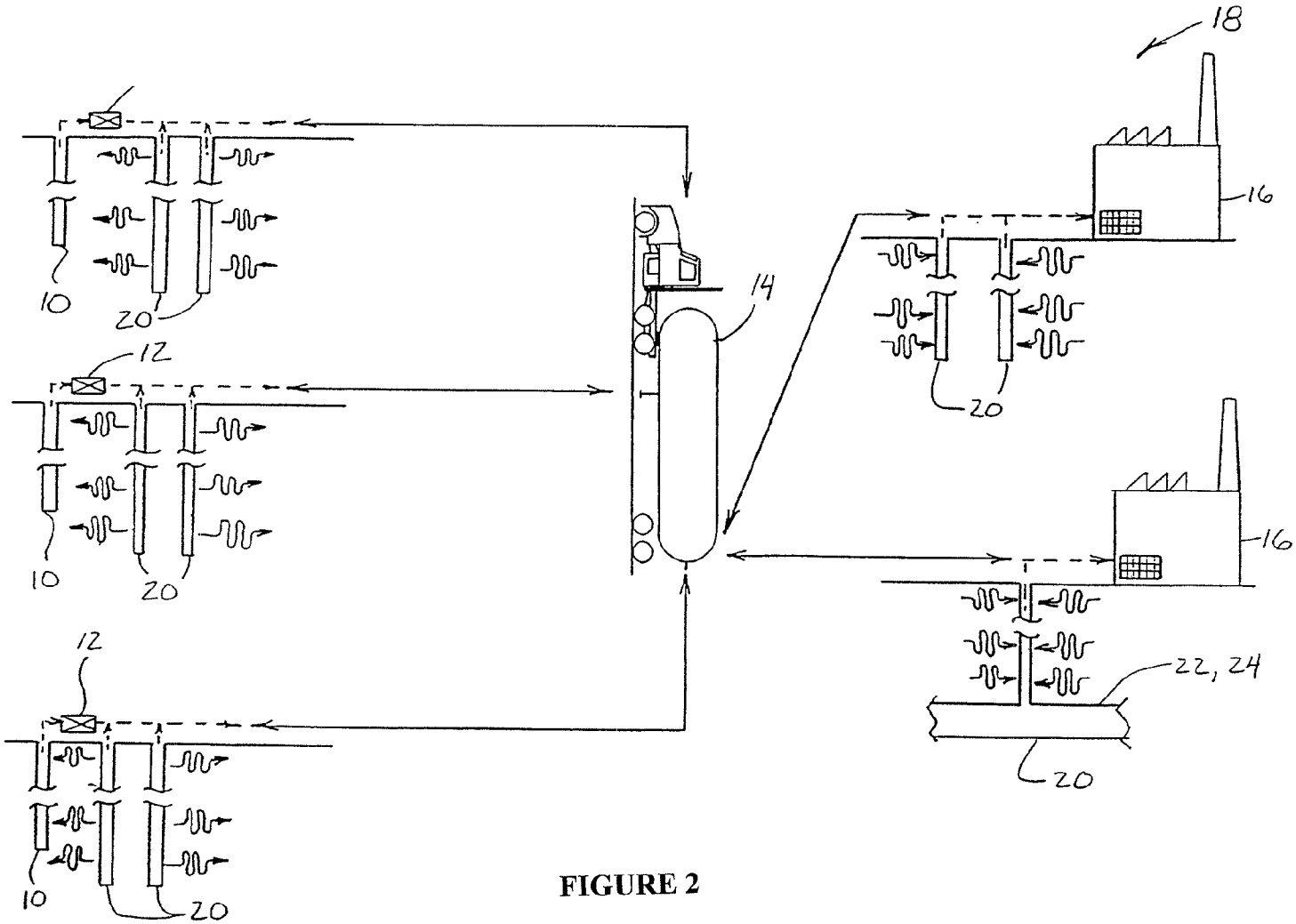
FIG. 2 is a simplified schematic diagram of a method and apparatus of the invention for recovering and transporting methane gas.

Referring now to FIG. 2, exemplary embodiments of a system, method and apparatus 18 of the present invention for recovering and transporting methane gas from a source, e.g., a producing well, such as one or more gas wells 10, to an end user, such as, but not limited to, co-firing power plant 16, is shown. Apparatus 18 of the system of the invention preferably includes at least one, and more preferably two or more, subterranean capacitors 20, optionally in the vicinity of each gas well 10, into which methane gas from a producing well 10 can be compressed, by a compressor, such as compressor 12 shown, or other suitable apparatus. Each capacitor 20 can be a non-producing oil well, a producing oil well (e.g., FIG. 3), or a newly-constructed subterranean cylinder (e.g., FIG. 4), having a capability of receiving and holding compressed methane gas, at a suitable pressurization, such as the 3,000 psi pressure typically used in transport tankers, such as tanker 14.

Some oil wells have been found to have the capacity to hold gas pressurized to up to 4,000 psi without significant leakage. A typical oil well (or subterranean cylinder) which is suitable for use as a capacitor 20, will be several hundred feet deep, and, more preferably, will be several thousand feet deep, for instance, 3,000 feet deep, which is a common depth of oil wells found in the vicinity of coal mines in the Southern Illinois and Western Kentucky regions of the USA, where methane is typically found in extractable quantities in coal mines and is presently extracted using gas wells, such as the wells 10. A suitable oil well (or subterranean cylinder) utilizable as a capacitor 20 of the invention will be of a diameter of several inches, for instance, 4 to 10 inches, and commonly 8 inches in diameter, and will be encased in a steel casing. An oil well (or subterranean cylinder) utilized as a capacitor 20 may also include a smaller diameter production tube extending downwardly therethrough. The oil well (or subterranean cylinder) will also typically be encased in cement or concrete. As noted above, oil wells such as this are commonly found in the general vicinity of gas bearing coal mines, and are often considered to be a liability to the owners of the oil wells, as they can cost several thousand dollars to plug. Thus, the owners of such oil wells are often eager and willing to allow alternate usage of them.

It has been found that a 3,000 foot deep oil well (or subterranean cylinder) having an 8 inch diameter casing can receive and hold 300 mcf of methane gas at a pressurization of 3,000 psi. Thus, two capacitors 20 in the vicinity of a producing gas well 10 can be expected to be capable of holding 600 mcf of methane gas, which would equal the capacity of two tankers 14. As a particular advantage of using at least one, and preferably two or more, capacitors 20 for receiving and holding gas extracted from a gas well 10, no transport tanker 14 or above ground storage tank is required to be present, and the compressing of the gas into the one or more capacitors can be performed on a continuous, or 24 hour a day, basis. It has also been found that a smaller compressor 12 can be used, compared to that which is typically used for compressing gas into a transport tanker 14.

Additionally, the earth surrounding and in intimate contact with each of the capacitors 20 will have a normalized temperature which is substantially equal to the average temperature in that region, for instance, in the mid-50 degrees Fahrenheit range, as is common in the Southern Illinois and Western Kentucky region. As a result, it has been found that the surrounding earth will serve as an excellent heat insulator for holding heat in the compressed gas, such that the gas will lose heat only slowly, and thus, will remain at an elevated temperature. And, because the gas is not being compressed into a tank, overheating is not as great a concern. Heat dissipation into the surrounding earth is represented in the Figures by the wavy arrows emanating from each of the capacitors 20. This represents the slowed heat transfer resulting from the insulating effect of the surrounding earth.

Still further, as a particular advantage, when a tanker is connected to one or more capacitors 20, it has been found that loading of the tanker can be achieved quickly, because little or no compression of the gas being drawn from the capacitor or capacitors 20 is required, as the gas in the capacitor or capacitors 20 is already compressed to, or close to, the desired pressurization of 3,000 psi.

It has further been found that a single capacitor 20 holding 300 mcf of gas, or about half the gas contained in two capacitors 20 holding 600 mcf of gas, such as described above, can be loaded to a tanker with a 300 mcf capacity relatively quickly, for example, in one half hour or less. One reason for this is that the temperature drop experienced as a result of transfer to the initially lower pressure environment of the tanker, will be from the elevated temperature of the capacitor, not an ambient air temperature or the like, such that the end temperature will not be as close to the freezing temperature of the gas.

One or more capacitors 20 according to the present invention can also be advantageously utilized at the end user or other unloading site. Such capacitors 20, can be one or more of any of several different forms. For instance, a capacitor 20 could be an existing well, such as a producing or nonproducing oil well, as explained above. A capacitor 20 could also include an abandoned or unused coal mine 22, or an underground formation of rock 24, such as sand rock or the like. Still further, a capacitor 20 could also include a subterranean cylinder that is constructed near the producing well 10 for the sole purpose of receiving and storing gas in the cylinder, as described herein, or a newly-constructed subterranean cylinder that is located near vehicles (for the purpose of loading vehicles with gas to be used as a source of fuel for operation). In certain embodiments, prior to connection of a loaded tanker (such as tanker 14) to a capacitor or capacitors 20 at the unloading or end-user site, the capacitor or capacitors 20 can be preloaded with pressurized gas.

This can provide several advantages, including, but not limited to, the ability to unload into an already pressurized environment, such that the gas being unloaded is not as greatly chilled as would ordinarily occur if unloaded into a much lower pressure environment. The gas holding capacity of the capacitors 20, particularly, a large formation of sand rock or the like, or a coal mine, can be quite large, for instance, larger than the capacity of a single tanker. As a result, when the gas is withdrawn from the capacitors 20, the remaining pressurized gas in the capacitors 20 can provide adequate pressure for the unloading of the gas. Thus, the gas in the formation can act as, or provide, a cushion in the gas holding system which will facilitate absorption of the gas into the system, and then drive the gas being unloaded from the system. Still further, by unloading the gas from a tanker into an already pressurized capacitor or capacitors 20, less depressurization occurs, resulting in less temperature drop in the gas. Once in the capacitor or capacitors 20, heat from the surrounding formation can be absorbed into the pressurized gas contained in the capacitor or capacitors 20, as illustrated by the wavy arrows, so as to raise the temperature thereof, such that there will be less occurrence of freezing of regulators and other apparatus as the gas is withdrawn therefrom. In the instance of a capacitor which is an oil well (or subterranean cylinder), it is preferred to use an oil well (or subterranean cylinder) having an internal casing diameter of several inches, for instance, 8 inches, and a depth of at least several hundred feet, and preferably several thousand feet, for instance, 3,000 feet as commonly found in unused oil wells in the southern Illinois and Kentucky regions of the United States.

Still further, at the unloading end, when pressurized gas from a tanker 14 is unloaded into an already pressurized capacitor 20, little or an insignificant amount of the original pressurization from the loading process is lost, and, when the gas is withdrawn from the capacitor 20, it is typically desired to be at a substantially lower pressure, for instance, less than 100 psi, such that no compressor capability is required at that site. Cost of additional compressing of the gas at that location is also avoided. If it is desired or required to further pressurize gas introduced into a capacitor or capacitors 20 at the unloading site, when a compressor is used and the gas is resultantly heated, the surrounding formation can again serve as a heat sink for dissipating the extra heat, as explained above.

Figure 3:
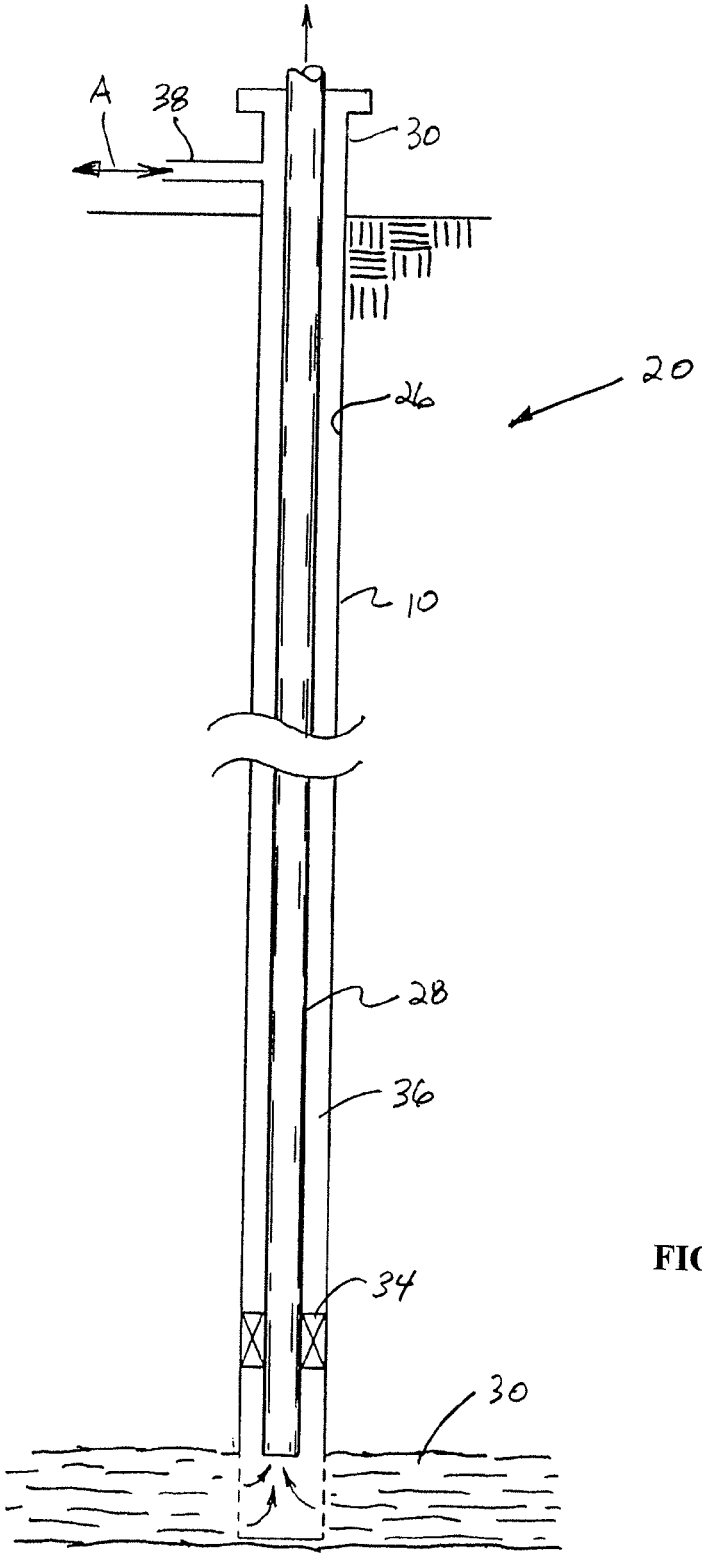
FIG. 3 is a simplified side view of an oil well adapted for use as a capacitor according to the invention.

Referring to FIG. 3, a producing oil well 10, is illustrated, used as a capacitor 20 according to the teachings of the present invention. Well 10 includes a casing 26 which can be of several inches in diameter, for instance 8 inches, as is commonly used for casing wells in the southern Illinois and Kentucky regions. Well 10 can be several thousand feet deep, for instance 3,000 feet deep, as is also common in those regions. A well 10 will often include a much smaller diameter tube 28, for instance of about 2 inches, extending therethrough which extends from the well head 32 to underlying gas or oil formation 30 for drawing gas or oil therefrom, as denoted by the arrows, for instance, using formation pressure and/or pumping. To facilitate use as a capacitor 20, a plug 34 can be inserted in the oil well 10 at a desired depth above the producing formation 30, for isolating an annular space 36 surrounding tube 28 above formation 30, from the formation 30, such that the space 36 can be used as the capacitor for receiving and holding compressed gas introduced into space 36 through a port 38, as denoted by arrow A. Port 38 can also be used for unloading capacitor 20, in the above described manner. As a result, it should be evident that either a producing or nonproducing well can be utilized as a capacitor 20 according to the present invention. Such wells have been found to have a pressure capacity of 4,000 psi, which renders the wells suitable for use as a capacitor at a pressure of the desired 3,000 psi.

Another aspect of the present invention is directed to a subterranean storage and collection apparatus including a capacitor and an outer sheath and region between the capacitor and sheath for collecting any gas that leaks or otherwise escapes from the capacitor. The storage and collection apparatus is similar in form and operation to the storage and service apparatus described in U.S. Pat. No. 5,207,530 (hereby incorporated by reference herein in its entirety), with various modifications that provide enhanced storage and collection of compressed gas.

Figure 4:
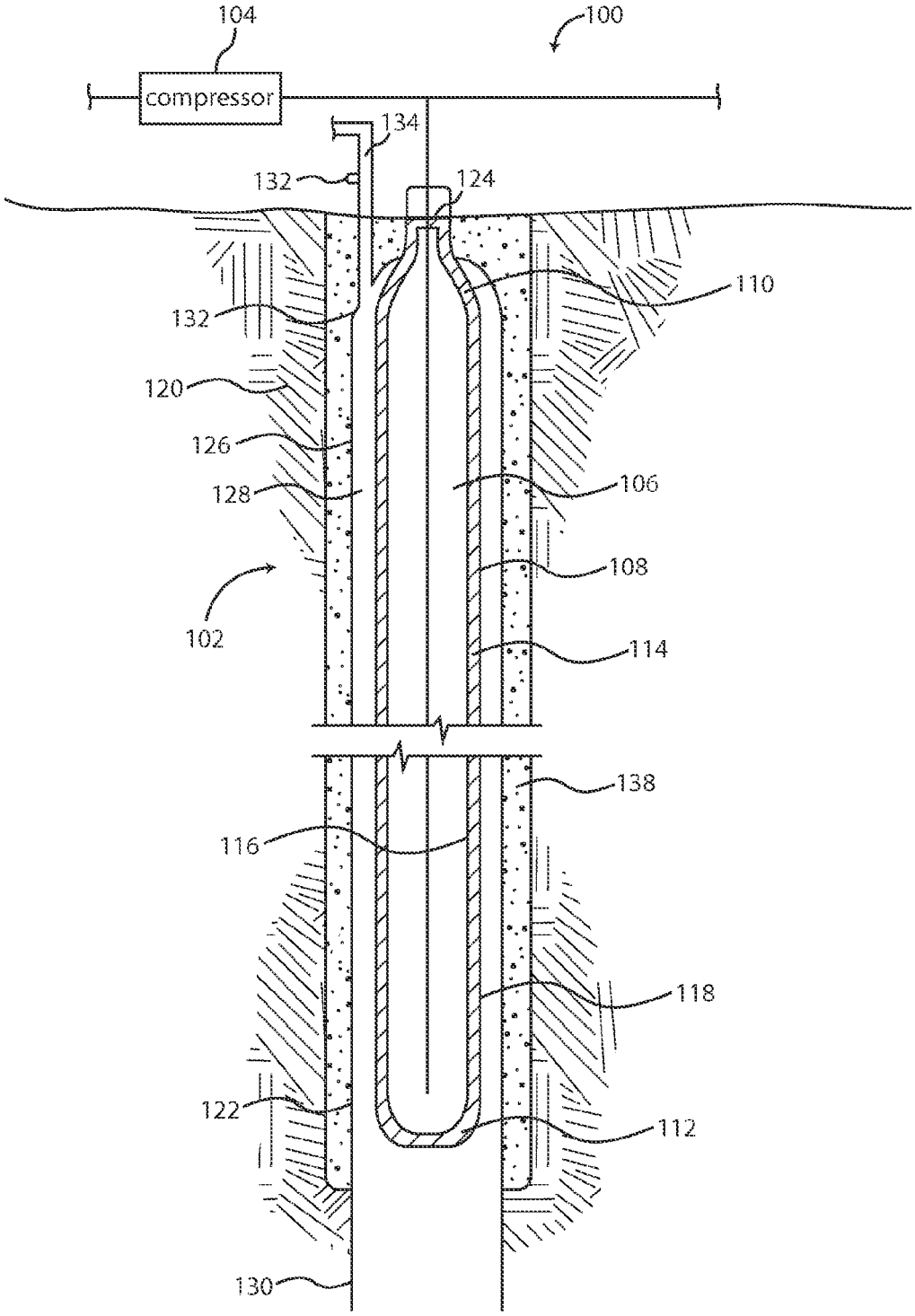
FIG. 4 is a side view of a storage and collection apparatus according to the invention.

Referring now to FIG. 4, the storage and collection apparatus 100 will be described. The apparatus typically comprises at least one capacitor 102, a compressor 104 for optionally compressing gas from a producing well and/or a transport tanker for storage in the capacitor. Various conventional pipe networks (not shown) may also be provided for transporting gas, for example, from a producing well, another capacitor, and/or a tanker to and/or from the capacitor 102.

The capacitor generally includes a vessel or cylinder 106 having a perimeter wall 108 defining an inner cavity 110. The perimeter wall 108 includes top and bottom ends 110, 112 and a middle section 114 connecting the bottom and top ends. The perimeter wall 108 also includes an inner surface 116 and an outer surface 118. As is typical, a substantial portion of the capacitor is positioned below the surface 120 and underground. For example, the vessel 106 is typically positioned in an elongated borehole 122 drilled into the ground. The top end 110 has at least one opening or port 124 for connection to the pipe network for gas entry and release.

In contrast to prior art storage systems which have a reinforcing layer of cement or concrete immediately surrounding the subsurface portions of the perimeter wall 108, the apparatus of the present invention includes a sheath 126 surrounding the perimeter wall 108 and defining an open region 128 between the outer surface 118 of the perimeter wall and the sheath 126. Where the sheath and the vessel are each cylindrical, for example, an annular region 128 is formed. As shown, sheath 126 is typically open at the bottom sheath end 130 and forms a closed top sheath end 132 proximate the top end 110 of the vessel 106. Depending upon the depth of the vessel 106, the open sheath end 130 may or may not extend past the bottom end 112 of the vessel 106.

In general, the diameter of the sheath 126 is anywhere from about 1.05 times to about 5 times (e.g., 1.25, 1.5, 1.75, 2, 2.25, 2.5, 2.75, 3, 3.25, 3.5, 3.75, 4, 4.25, 4.5, 4.75, or 5 times) the diameter of the cylinder 106. Thus, for example, for a cylinder having a diameter ranging between 4 and 10 inches, the sheath may have a diameter ranging between 4.2 and 50 inches.

In operation, any gas leaking from the subsurface regions of the vessel 106 will enter the open space 128 and will flow upwards towards the surface and collect at the closed top sheath end 132. Additionally, therefore, the closed top sheath end 132 may be fitted with a port and/or vent/collection tube 134 for venting and/or collecting any gas that enters region 128. Still further, the closed top sheath end 132 and/or the tube 134 may be equipped with a detector, such as a monitor and alarm to detect and/or signal whether and to what extent any gas is present in the open region and thus has escaped from the vessel.

A reinforcing layer of concrete or cement 138 typically surrounds the sheath 126 to protect it and the vessel 106 from corrosion and the environment. The thickness of the cement can vary; typically, the cement layer is about 2 to about 4 inches thick, or otherwise any thickness to fill any space between the borehole 122 and the sheath 128.

In general, any other conventional components and systems known in the art can be further included on or with the apparatus of the present invention. It will also be understood that the sheath may be applied to existing subterranean capacitors, or may be included in new capacitor installations.

The invention also provides that oil fields, such as in the southern Illinois and Kentucky regions of the United States, commonly include wells drilled in a predetermined pattern, such as on 330 feet for 660 feet center-to-center spacings. Such distances are sufficiently small such that two or more of the wellheads can be economically connected together by high-pressure pipe. This is true both at the loading site and also the unloading site, such as an end user or the like.

According to still further aspects of the invention, therefore, methods for delivering gas (preferably processed gas) to a tank of a vehicle are provided, for the purpose of providing the vehicle with a source of fuel for operation.

Such methods generally comprise transferring gas from a producing well (or another source) to one or more subterranean capacitors as described herein, and storing the gas in the one or more subterranean capacitors. Preferably, the gas will be processed (as fuel for Natural Gas-compatible engines) following extraction from the producing well, and prior to storage in the subterranean capacitor.

In accordance with certain preferred embodiments, the gas is then loaded from the capacitor(s) into a tanker at a rate that would be effective to load 300 mcf of gas to a pressure of at least about 3,000 psi in thirty minutes or less. Thus, for example, the tanker can be loaded to a pressure of about 3,000 psi, about 3,100 psi, about 3,200 psi, about 3,300 psi, about 3,400 psi, about 3,500 psi, about 3,600 psi, or greater. Typically, the tanker is loaded to a pressure between 3,000 psi and 4,000 psi, more preferably between about 3,000 psi and about 3,600 psi (e.g., about 3,050 psi, about 3,100 psi, about 3,150 psi, about 3,200 psi, about 3,250 psi, about 3,300 psi, about 3,350 psi, about 3,400 psi, about 3,450 psi, about 3,500 psi, about 3,550 psi, or about 3,600 psi).

In one embodiment, the tanker then transfers the loaded gas to one or more subterranean capacitors, distinct from, and typically at a location remote from, the original subterranean capacitor(s), the producing well, and/or the processing center. The location of the second one or more subterranean capacitors may be anywhere from about one mile, about two miles, about five miles, about 10 miles, about 15 miles, about 25 miles, about 50 miles, about 100 miles, about 250 miles, or about 500 miles, or more, away from the original subterranean capacitor(s), the producing well, and/or the processing center. At this point, a vehicle, including a car, truck, bus, or other vehicle that includes a methane- or Natural Gas-compatible engine, can be refueled at a fixed location or station in close proximity to these one or more remote subterranean capacitors, by loading and transferring the gas from the one or more subterranean capacitors into the gas tank of the vehicle.

In another embodiment, after loading the tanker with gas from the subterranean capacitor, the tanker is then capable of directly refueling a vehicle using the gas contained in the tanker. In this way, the tanker functions as a mobile refueling station. Thus, vehicles can be refueled at locations anywhere from about one mile, about two miles, about five miles, about 10 miles, about 15 miles, about 25 miles, about 50 miles, about 100 miles, about 250 miles, or about 500 miles, or more, away from the nearest subterranean capacitor(s), producing well, and/or processing center. In certain of these embodiments, it is possible to refuel a number of vehicles without the use of a compressor, given the pressure of the gas in the tanker. Typically, for example, from about four to about eight vehicles can be refueled without the use of a compressor. Once the pressure within the tanker reaches a certain point after the filling of multiple vehicles, a compressor may be used to fill anywhere from about four to about eight additional vehicles. Assuming that the tanker holds about 300 mcf of gas as noted above, approximately 10 to 16 vehicles, e.g., 10, 11, 12, 13, 14, 15, or 16 vehicles, may be refueled using a single tanker; typically, around 12 vehicles can be refueled.

In the foregoing embodiments in which gas is loaded from a subterranean capacitor to a vehicle tank or from a tanker to a vehicle tank, for example, the "tank" is a containment system housed within, or otherwise connected to, the vehicle for the purpose of providing combustible fuel to the engine of the vehicle. The invention provides that such methods and systems allow a tank of the vehicle to be loaded with gas at a rate of at least about 1 mcf per minute, to a final pressure of at least about 3,000 psi.

In various embodiments described herein, the delivery of gas from a tanker containing compressed gas involves the use of an improved threaded union between the tank of the vehicle and the tanker. The threaded union generally comprises a first mating unit on the tank of the vehicle, typically at the inlet/outlet port on the tank, or a similar port for loading compressed gas into the tank. The threaded union also comprises a corresponding mating unit positioned distally on a hose connected to the tanker for dispersing or releasing the compressed gas. Either the first mating unit or the second mating unit may include threads for engaging with corresponding threads on a nut that draws together the respective mating ends, thus providing a high-pressure seal. Advantageously, the threaded union ensures that the components are securely connected and eliminates the possibility of unexpected release or "pop off" that can occur during high-pressure transfer of gas when conventional connectors such as "quick release" snap-on/off nozzles are employed.

Figure 5:
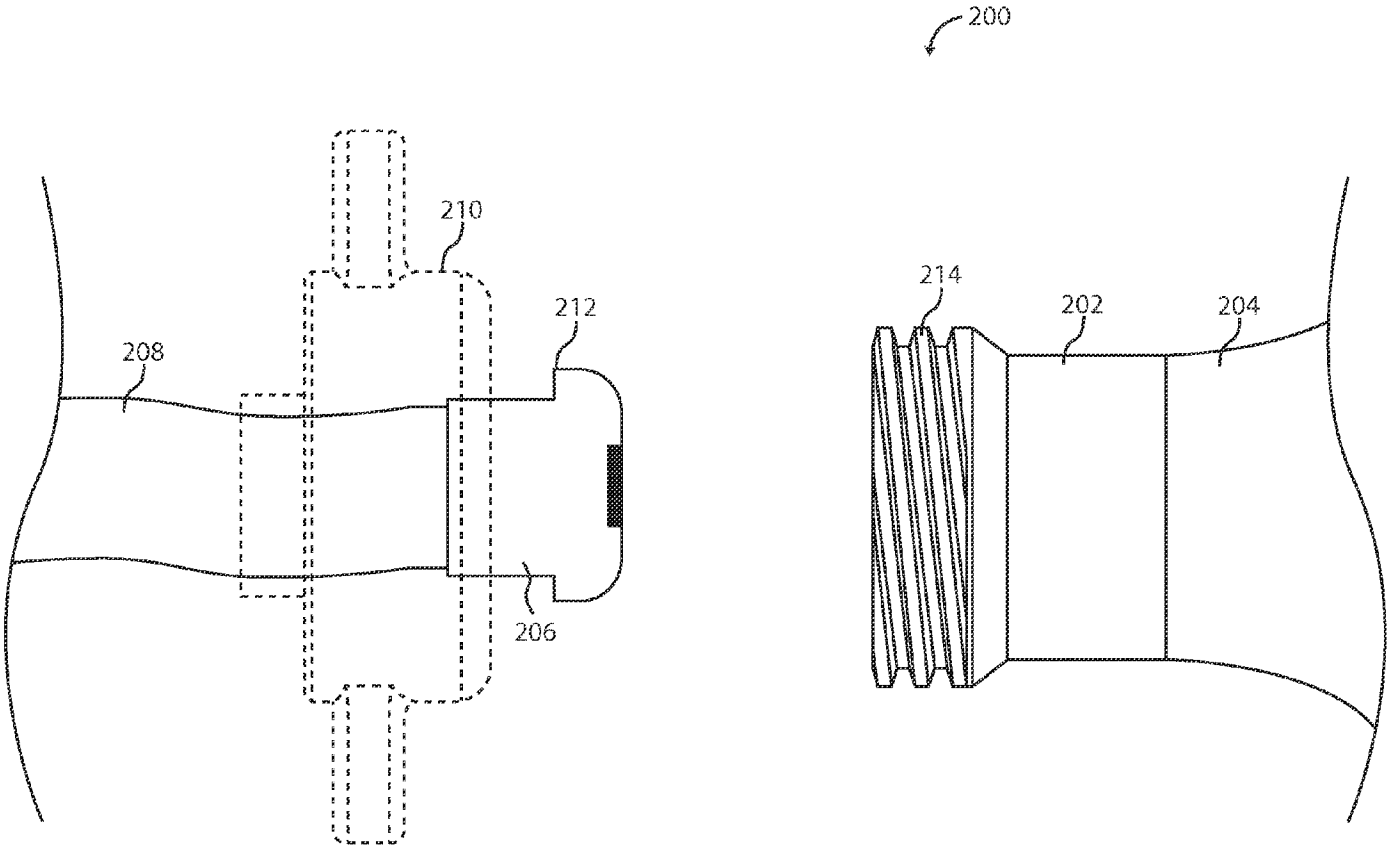
FIGS. 5 and 6 are side views of a threaded union in accordance with the invention in joined and unjoined positions.
Figure 6:
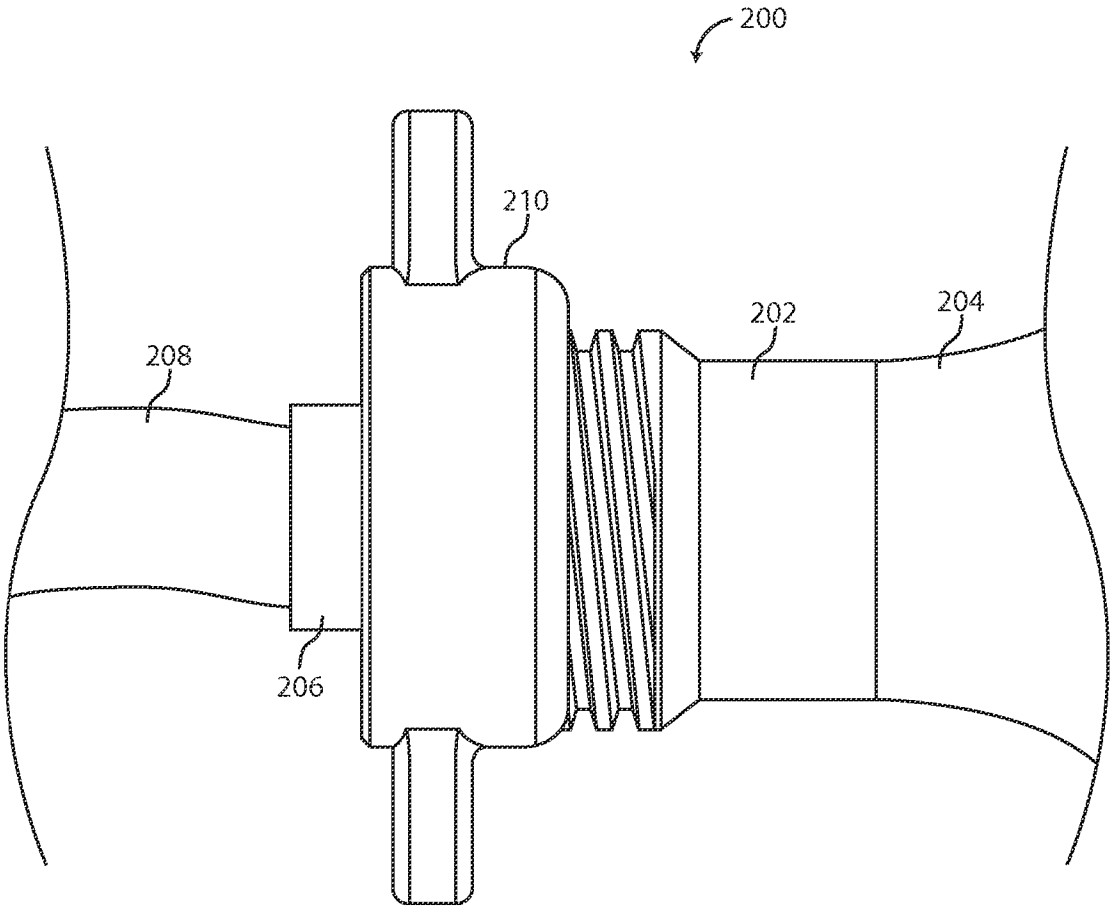

An exemplary threaded union arrangement 200 is depicted in FIGS. 5 and 6. As shown, the first mating unit 202 is connected to the tank 204 of a vehicle, and the second mating unit 206 is connected to a hose 208 that is further connected to a tanker containing compressed gas (not shown). Nut 210, which is depicted in the illustrated embodiments as a "wing nut" of a standard hammer union, includes an internal stop (not shown) that corresponds with a stop 212 on the second mating unit, and also includes an internal threaded region (not shown) which engages with the threads 214 of the first mating unit to draw together the respective mating units. Nut 210 is shown in dotted lines in FIG. 5 for ease of viewing the hose and second mating unit connected thereto. Similarly, for ease of viewing the various components, FIG. 6 shows the mating units in a joined position; although some threads 214 can still be seen in the drawings, it will be understood that the threads may or may not be visible when the mating units are completely joined via the nut 210. As a possible alternative, the first mating unit may be positioned on the hose and the second mating unit and the nut may be positioned on the tank of the vehicle. Typically, however, the nut will be provided on the hose end of the arrangement, as opposed to on the tank end, in order to prevent rattling or damage during motion or movement of the vehicle. In certain embodiments, the first and/or second mating units may further include one or more gaskets and/or sealing washers to provide an air- and/or water-tight seal when the threaded union is joined. When not joined and/or not otherwise in use, the first and/or second mating units may also include threaded plugs to prevent dirt and debris from entering the tank port and/or the hose. Furthermore, the arrangement may include other components such as flow meters, regulators, and check valves in accordance with conventional gas transfer techniques.

Thus, there has been shown and described novel methods and apparatuses for recovering, transporting, and using methane gas, which overcome many of the problems set forth above. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

What is claimed is:

1. A compressed gas storage and collection apparatus comprising:

one or more storage capacitors including a gas vessel positioned partially or completely underground, the storage capacitor including a gas vessel having a perimeter wall defining an inner cavity for the storage of gas, the perimeter wall including a middle section connecting a bottom end and a top end, an inner surface, and an outer surface; and a sheath surrounding the perimeter wall and extending from a closed top portion proximate the top end of the perimeter wall towards an open end proximate the bottom end of the perimeter wall, the sheath defining an open region between the outer surface of the perimeter wall and the sheath for the collection of escaped gas from the vessel.

2. The apparatus of claim 1, wherein the apparatus further comprises a compressor for compressing gas for storage in the storage capacitor.

3. The apparatus of claim 1, further comprising a reinforcing layer surrounding the sheath.

4. The apparatus of claim 3, wherein the reinforcing layer is cement or concrete.

5. The apparatus of claim 1, further comprising a tube for removing gas from the open region.

6. The apparatus of claim 1, further comprising a device for detecting the presence of gas in the open region and signaling such presence.

7. The apparatus of claim 1, further comprising a pipe network for transporting gas from one or more of a producing well, another capacitor, and a tanker, to and from the capacitor.

8. The apparatus of claim 1, wherein the gas is selected from the group consisting of methane gas, natural gas, combinations thereof, and constituents thereof.

9. The apparatus of claim 1, wherein the vessel and the sheath are substantially cylindrical and the open region is an annular region.

10. The apparatus of claim 1, wherein the vessel has a diameter ranging between 4 and 10 inches.

11. The apparatus of claim 10, wherein the vessel is at least 300 feet in length.

12. The apparatus of claim 10, wherein the vessel is at least 3,000 feet in length.

13. The apparatus of claim 10, wherein the vessel is capable of holding at least 300 mcf of methane gas at a pressurization of at least 3,000 psi.

14. The apparatus of claim 1, wherein stored gas is transferred to the vessel from a producing well to the vessel via (i) a tanker, (ii) a pipeline, or (iii) any combination thereof.

15. The apparatus of claim 1, comprising a plurality of storage capacitors.

* * * * *